US010519978B2

(12) United States Patent
Gebert et al.

(10) Patent No.: US 10,519,978 B2
(45) Date of Patent: Dec. 31, 2019

(54) BLADE OF A VENTILATOR WHEEL, VENTILATOR WHEEL AND AXIAL VENTILATOR

(71) Applicant: ebm-papst Mulfingen GmbH & Co. KG, Mulfingen (DE)

(72) Inventors: Daniel Gebert, Oehringen (DE); Erhard Gruber, Satteldorf (DE); Oliver Haaf, Kupferzell (DE); Thorsten Pissarczyk, Gemmingen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 338 days.

(21) Appl. No.: 14/936,842

(22) Filed: Nov. 10, 2015

(65) Prior Publication Data

US 2016/0160878 A1 Jun. 9, 2016

(30) Foreign Application Priority Data

Dec. 3, 2014 (DE) ..... 10 2014 117 795
Jan. 20, 2015 (DE) ..... 10 2015 100 767

(51) Int. Cl.

| | |
|---|---|
| ***F04D 29/66*** | (2006.01) |
| ***F04D 29/16*** | (2006.01) |
| ***F04D 29/38*** | (2006.01) |
| ***F04D 29/32*** | (2006.01) |
| ***F04D 29/54*** | (2006.01) |

(52) U.S. Cl.
CPC ..... *F04D 29/666* (2013.01); *F04D 29/164* (2013.01); *F04D 29/325* (2013.01); *F04D 29/384* (2013.01); *F04D 29/545* (2013.01)

(58) Field of Classification Search
CPC .... F04D 29/666; F04D 29/164; F04D 29/325; F04D 29/384; F04D 29/545
See application file for complete search history.

(56) References Cited

U.S. PATENT DOCUMENTS 5,181,830 A * 1/1993 Chou ..... F04D 29/384 416/223 R
6,994,523 B2 * 2/2006 Eguchi ..... F04D 29/384 416/228

FOREIGN PATENT DOCUMENTS

GB 2050530 A * 1/1981 ..... F01D 5/20

* cited by examiner

*Primary Examiner* — Ninh H. Nguyen
*Assistant Examiner* — Maxime M Adjagbe
(74) *Attorney, Agent, or Firm* — Harness, Dickey & Pierce, P.L.C.

(57) ABSTRACT

The invention relates in particular to a ventilator wheel of an axial ventilator, which includes multiple blades, each having radially outward extending blade forward edges and radial outer edges on the outlet side, wherein a transition from the radial outer edges to the blade forward edges is formed, in each case with a projection extending in the circumferential direction relative to the adjacent, radially outward extending blade forward edges, wherein a seamless transition is formed from the radial outer edge portion (7) to a region of the respective blade situated radially further inward.

13 Claims, 4 Drawing Sheets

BLADE OF A VENTILATOR WHEEL, VENTILATOR WHEEL AND AXIAL VENTILATOR

CROSS REFERENCE TO RELATED APPLICATIONS

This application claims the benefit and priority of DE 102015100767.3 filed Jan. 20, 2015 and DE 102014117795.9 filed Dec. 3, 2014. The entire disclosures of each of the above applications are incorporated herein by reference.

DESCRIPTION

The invention relates to a blade of a ventilator wheel, a ventilator wheel of an axial ventilator, as well as an axial ventilator having such a ventilator wheel.

In ventilator wheels of axial ventilators, in particular, those designed with a wall ring, the primary noise source is known to be situated in the radial outer edge region of the blades, since it is here that the flow velocities are very high. In one design having a wall ring, a small gap is provided between the radial blade ends of the ventilator wheel and the wall ring, in the region of which increased noise is likewise easily produced due to the high turbulences.

In addition, the inward flow of the air effects the noise level of the ventilator wheel during operation. Disruptions of the flow may result in higher turbulence, in particular, just prior to the flow cut-off, and in an interaction with the front edges of the blades. In addition to undesirable noises, the turbulences also negatively impact the operating efficiency, in particular in the upper pressure region.

Therefore, the object of the invention is to provide a blade design, a ventilator wheel for an axial ventilator and an axial ventilator, which exhibit both an improved noise behavior, in particular, in the upper pressure region and a higher efficiency, and are less sensitive to misaligned incident flows.

To achieve the object according to the invention, a blade for a ventilator wheel is first proposed, which has a blade forward edge extending radially outward on the outlet side and a radial outer edge, wherein a transition from the radial outer edge to the blade forward edge is formed with a projection extending in the circumferential direction relative to the adjacent, radially outward extending blade forward edge, such that the blade edge width locally delimited in a radial outer edge portion that includes the projection, is enlarged around the projection, wherein a seamless transition is formed from the radial outer edge portion to a region of the respective blade located radially further inward.

To achieve the further object according to the invention, a ventilator wheel of an axial ventilator is proposed, which has multiple blades as previously described. Refinements of the ventilator wheel are described below, which also apply explicitly for each embodiment of the blades alone, i.e., independently of the ventilator wheel.

The radial outer edge portion is defined as a portion situated radially in the outer region of the respective blade, in the extension of which the projection is formed in the circumferential direction. The radial outer edge portion is bounded in the radial direction by the radial outer edge of the respective blade. The blade edge width is defined as the blade width in the circumferential direction at an imaginary edge before, as viewed in the radial direction, the radial outer edge portion that includes the projection begins. The blade forward edges extend radially outward up to the radial outer edge portion before they transition to the projection situated in the radial outer edge portion.

Because the particular geometric configuration of the radial outer edge of the blades includes a projection in the transition to the respective blade forward edges, the noise production in the high pressure region is reduced, in particular also in the gap region when used with a ventilator wheel and fixed wall ring.

In one advantageous embodiment, the projection is formed on the individual blades, in each case as a lug-shaped extension of the radial outer edge portion and protrudes in the direction of rotation of the blade in the circumferential direction relative to the respective adjacent blade forward edges on the outlet side extending radially outward. As a result, the projection is the element that guides the air engagement and the flow to the blade. The flow along the blade and, in particular, along the radial outer edge portion is materially influenced by the projection.

With regard to the shape of the projection, it is also advantageous that it has an oval, more preferably, an elliptical cross section. The wider section of the oval or elliptical cross section in this configuration points toward the center, preferably in the direction of the center of the axial wheel, i.e., along the blade forward edges. In addition, it is provided in one embodiment variant that the projection, as viewed in the circumferential direction, tapers and is essentially semi-spherically designed, such that the semi-spherical head ensures the front-most flow engagement of the respective blade.

In one embodiment variant of the invention, it is provided that the projection protrudes from the adjacent blade forward edge in the circumferential direction over a length of 1%-20%, in particular 1%-10%, more preferably 5%-10% of the blade edge region. As described above, the blade edge width is measured at the imaginary edge to the radially outward region that includes the projection. The length of the projection may then be determined as a function thereof. Thus, a projection with a short length in the circumferential direction relative to the adjacent blade edge width is sufficient alone to achieve the advantageous effects.

In addition to the use of the projection, the noise production and increase in efficiency are further promoted by the fact that the respective radial outer edge portion of the blades is formed with a thickening in the front section adjacent the blade forward edge, i.e., are formed thicker in the axial direction. The rear section of the blades adjoining the blade rear edge and having an invariable, standard thickness serves as a reference variable for comparing the thickening. Thus, it is provided that the front portion of the blades has an axial thickness that is greater than an axial thickness in the rear portion adjacent the blade forward edges. Hence, the transition in the change of thickness in this configuration from the front portion to the rear portion is smooth.

It is also favorable if the radial outer edge portion of the ventilator wheel has a length in the radial direction of 5%, more preferably of 2.5% of the radius of the ventilator wheel. As a result, only the radially outermost region of the blades is adapted geometrically to the thickening and to the projection.

The extent of the thickening in the circumferential direction is likewise geometrically defined. In this case, it is advantageous if the axially thickened front portion has a width in the circumferential direction, which equals 50%, more preferably up to 70% of the blade edge width. The thickening decreases essentially continually from the front portion in the direction of the rear portion. The rear portion itself may be formed with a constant thickness.

In the ventilator wheel according to the invention, it is provided in a further exemplary embodiment that a winglet curved in the axial direction at a predetermined setting angle is formed along the outer edge of the respective blade, the profile of which transitions into the projection in the circumferential direction. The basic use of winglets on blades is known; according to the invention however, the winglet interacts with the projection and the thickening due to an integrated design and promotes the reduction of noise and increase in efficiency.

In one further development, the setting angle of the winglet relative to an adjacent plane defined by the blade surface in the front portion or in the region of the projection is smaller than in the rear portion. As a result, the flow in the radially outer region of the blade forward edge on the outlet side is increasingly influenced by the winglet in the region of the blades downstream in the flow direction essentially initially as a result of the geometric adaption via the projection and thickening.

The invention also comprises an axial ventilator having a fixed wall ring, inside of which a ventilator wheel as described above rotates. The embodiments of the ventilator wheel according to the invention are particularly effective when using a wall ring, since particularly strong turbulences occur in the gap region between the wall ring and the ventilator wheel.

All of the described features of the individual embodiment variants may be freely combined insofar as is technically possible. Other advantageous refinements of the invention are indicated in the subclaims or are depicted in greater detail below together with the description of the preferred embodiment of the invention with reference to the figures, in which:

Figure 1:
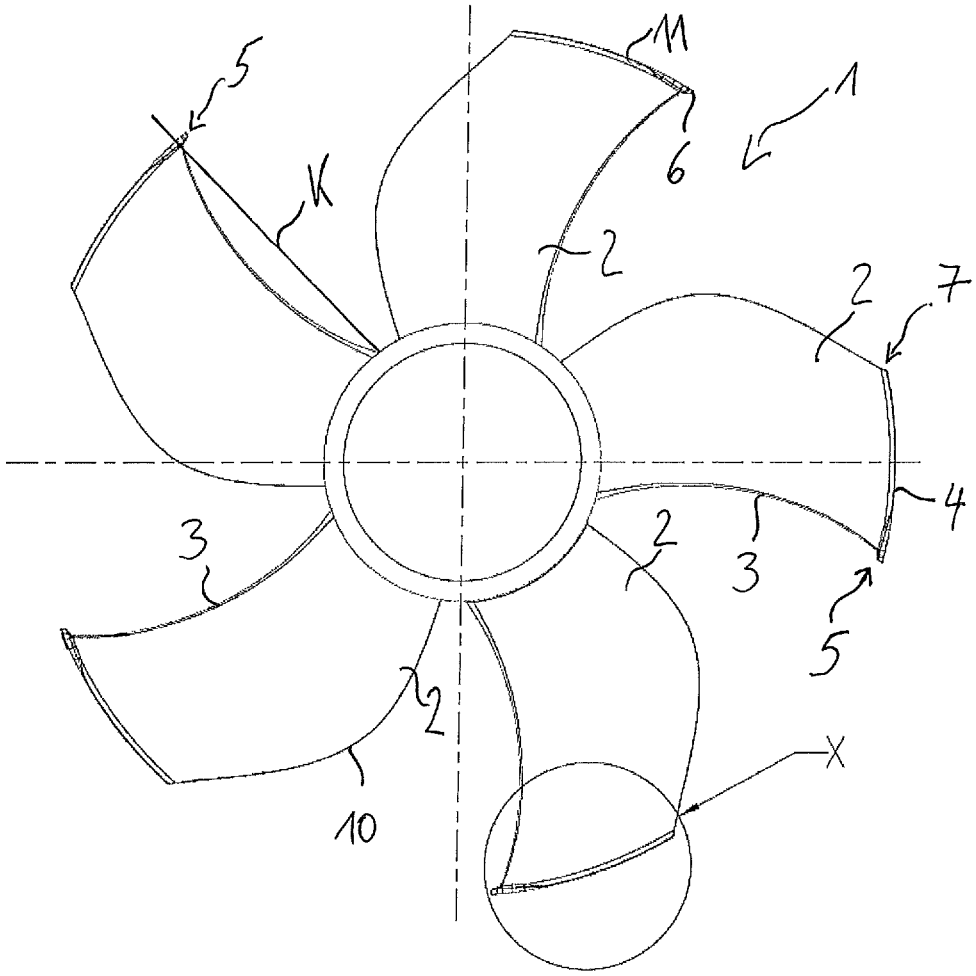
FIG. 1 shows a top view of a ventilator wheel.
Figure 3A:
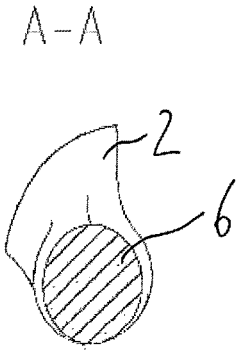
Figure 3B:
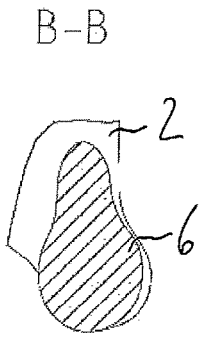
Figure 3C:
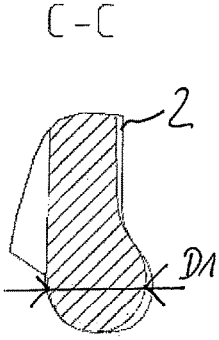
Figure 3D:
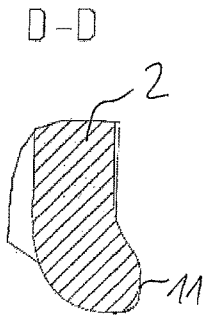
Figure 3E:
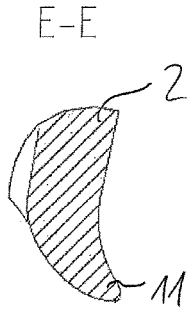
Figure 3F:
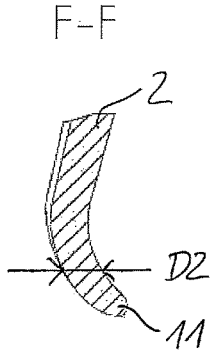
Figure 3G:
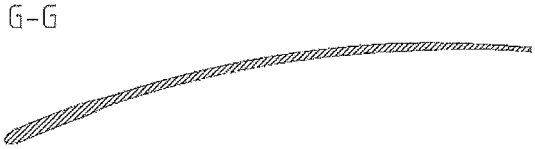
Figure 4:
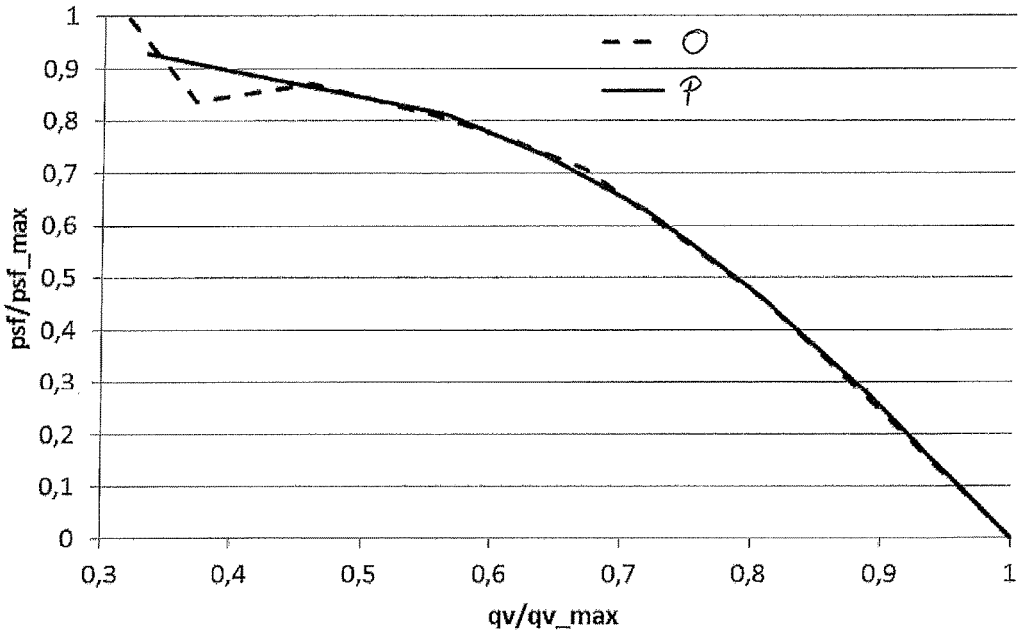
Figure 5:
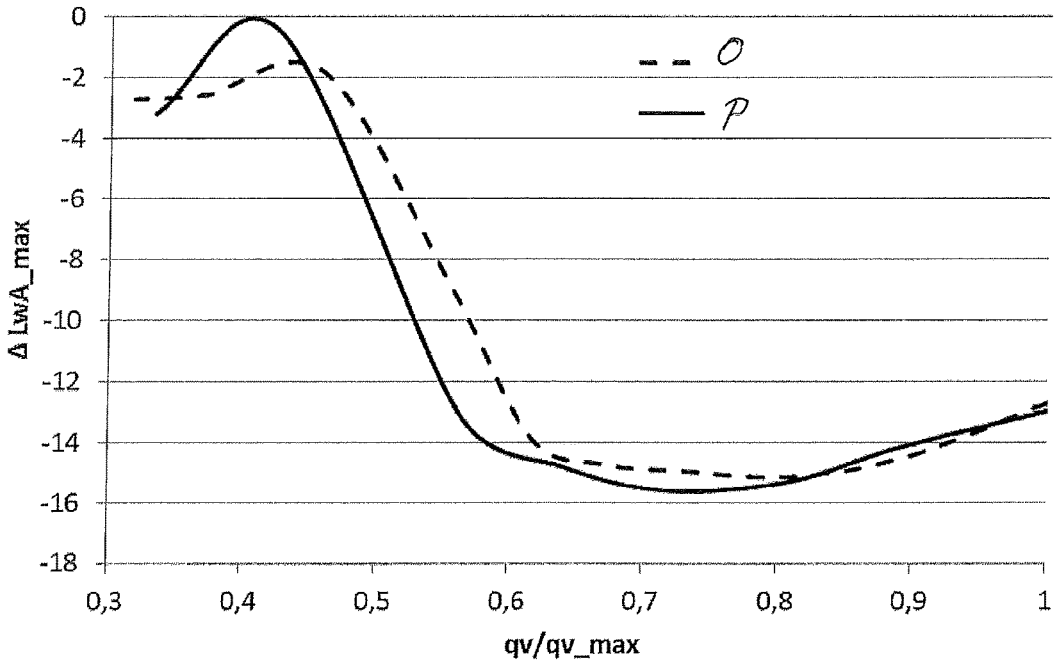

FIGS. 3*a*-3*g* show sectional views of the ventilator wheel from FIG. 1, FIG. 4 shows a diagram comparing the difference between the generated pressure difference of the ventilator wheel according to the invention and the prior art, FIG. 5 shows a diagram comparing the difference between the generated sound power level of the ventilator wheel according to the invention and the prior art.

Figure 6:
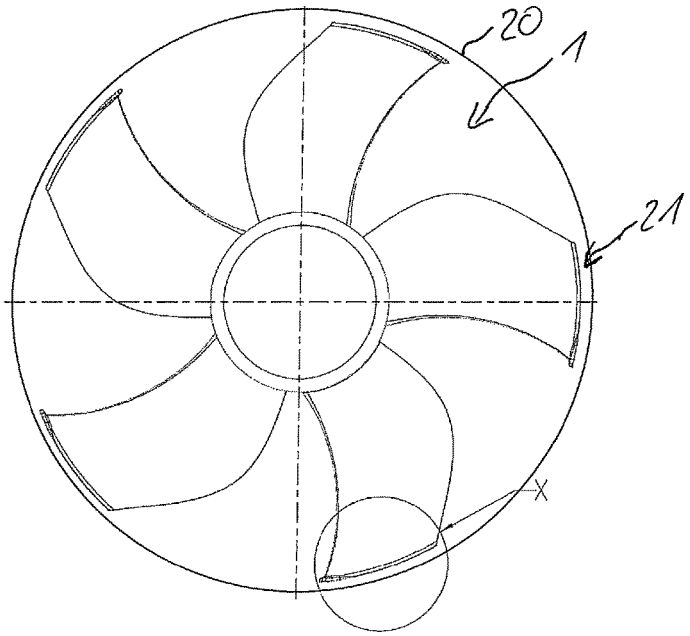

FIG. 6 shows an axial ventilator having a ventilator wheel and a wall ring.

FIG. 1 shows a top view of a ventilator wheel 1 of an axial ventilator, which has multiple blades 2 extending radially outward from a central hub region, each blade having radially outwardly extending, curved blade front edges 3 and blade rear edges 10 on the outlet side, as well as arcuate radial outer edges 4. Each of the blades 2 is identically formed, so that the description for one blade applies identically to all remaining blades.

The transition 5 from the radial outer edges 4 to the blade forward edges 3 is formed in each case with a projection 6 extending in the circumferential direction relative to the adjacent radially outwardly extending blade forward edges 3. The projection 6 in this configuration protrudes in each case over an imaginary connecting line K of the outermost radial edge point of the geometrically unvaried blade forward edge 3.

Figure 2:
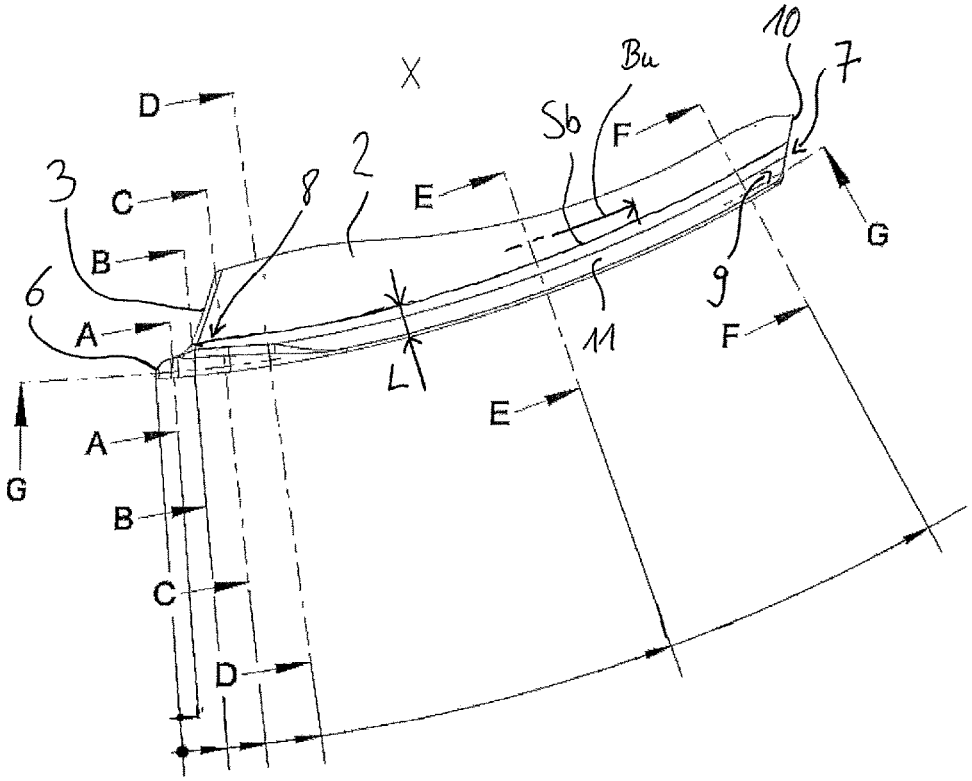
FIG. 2 shows a detail view X from FIG. 1.

FIG. 2 shows a detail view X from FIG. 1. The radial outer edge portion 7, in the extension in the circumferential direction of which the projection 6 is formed, is indicated in the radially outermost region adjacent to the radial outer edge 4 of the blade 2. The blade edge width Sb is defined as the blade width in the circumferential direction at an imaginary edge, before the radial outer edge portion 7 that includes the projection 6 as viewed in the radial direction begins. The radial outer edge portion 7 in this configuration has a length L in the radial direction of 2.5% of the radius of the ventilator wheel.

The blade forward edges 3 extend radially outward up to radial outer edge portion 7, before they transition into the projection 6 situated in the radial outer edge portion 7. As a result of the projection 6, the blade edge width Sb locally delimited in the radial outer edge portion 7 that includes the projection 6, is enlarged around the projection 6, so that the radial outer edge portion 7 has a width Sb plus the length of the projection 6. The length of the projection 6 protruding in the circumferential direction relative to the adjacent blade forward edge 3 corresponds to approximately 6.5% of the blade edge width Sb in the embodiment shown. The projection 6 in this case is designed as a lug-shaped projecting extension of the radial outward edge portion 7 having an essentially semi-spherical termination. Multiple sections A-A to E-E reproduced in the FIGS. 3*a*-3*e* are plotted in FIG. 2 in the circumferential direction. In addition, a section indicated in FIG. 2 is depicted in the circumferential direction G-G in FIG. 3*g*.

The sections 3*a*-3*g* show the geometric shape of the blade 2 in the radial outer edge portion 7. The projection 6 according to FIG. 3*a* has an elliptical cross section which transitions seamlessly into the shape of the blade 2 adjoining radially and in the circumferential direction.

In one region adjacent to the blade forward edge 3, a forward portion 8 is defined, in a region adjacent to the blade rear edges 10 a rear portion 9 is defined. The regions 8, 9 transition seamlessly into one another, however, the axial thickness D1 in the forward portion 8 is greater than the axial thickness D2 in the rear portion 9. This is exemplified in the FIGS. 3*c* and 3*f* with a difference in thickness of more than 20%. The thickening extends in the circumferential direction over a width Bu of 70% of the blade edge width Sb, measured from the forward blade edge 3. As depicted in FIG. 3*g*, a thickening in the radial direction also occurs in the region of the projection 6 and the adjacent portion.

A winglet 11 curved at a predetermined setting angle in the axial direction is formed as an integral part of the blade 2 along the axial outer edge 4 of said blade 2, as is apparent, for example, in FIG. 3*f*. The profile of the winglet 11 transitions into the projection 6 in the forward portion 8. The setting angle of the winglet 11 is reduced in the forward portion 8 and in the region of the projection 6 relative to the rear portion 9.

FIGS. 4 and 5 show diagrams as evidence of the improved noise level and increased efficiency of the ventilator wheel 1 as compared to a comparable ventilator wheel of the prior art. not having the features according to the invention In this case, FIG. 4 depicts the comparison of the pressure difference generated, FIG. 5 depicts the comparison of the difference in the sound power level between the ventilator wheel according to the invention (line P) and the prior art (line O). It is clear that with the embodiment of the blades 2 according to the invention, a uniform pressure curve according to FIG. 4 may be achieved, which according to FIG. 5 is reflected in a reduced sound level.

FIG. 6 shows an example of the use of the ventilator wheel 1 from FIG. 1 having a wall ring 20, wherein a circumferential gap 21, which contributes in particular to increased noise production, remains between the wall ring 20 and the ventilator wheel 1. Such noise, however, is correspondingly reduced when using the ventilator wheel 1 from FIG. 1 in the manner shown in FIGS. 4 and 5.

The design of the invention is not limited to the preferred exemplary embodiments specified above. Rather, a number of variants is conceivable, which make use of the solution depicted, even in embodiments of a fundamentally different type. For example, the blades may be variously shaped. The orientations selected above, such as "in the circumferential direction" should then be correspondingly applied to the shape of the blades. In the case of blades with straight, radial outer edges, this would result in the exemplary case cited in an extension not "in the circumferential direction", but rather "in the direction of the radial blade outer edge". The solution according to the invention remains the same, however.

The invention claimed is:

1. A blade of a ventilator wheel, the blade comprising:

a radially outward extending blade forward edge and a radial outer edge on an outlet side, wherein a transition from the radial outer edge to the blade forward edge is formed with a projection extending in a circumferential direction relative to the radially outward extending blade forward edge, so that a blade edge width locally delimited in a radial outer edge portion that includes the projection is enlarged around the projection, the projection has a semi-spherical termination at a forward portion adjacent to the blade forward edge, and a first seamless transition is formed from the radial outer edge portion to a region of the blade located radially further inward, the radial outer edge portion of the blade at the semi-spherical termination includes an axial thickness that is greater than an axial thickness in a rear portion adjacent to a blade rear edge, a second transition of the axial thickness is seamlessly formed from the forward portion to the rear portion; and a winglet is formed near the rear portion adjacent to the blade rear edge, the winglet is curved at a predetermined setting angle along an axial outer edge of the blade in an axial direction, the profile of the winglet transitions axially along the radial outer edge into the semi-spherical termination at the forward portion of the projection and the first and second transitions between the winglet and the semi-spherical termination are seamlessly formed both axially and from the radial outer edge portion to a radially inner portion of the blade.

2. A ventilator wheel of an axial ventilator, the ventilator wheel comprising:

multiple blades, each blade having a radially outward extending blade forward edge and a radial outer edge on an outlet side, wherein a first transition is formed from each of the radial outer edges to a respective blade forward edge, a projection extending in a circumferential direction relative to an adjacent radially outward extending blade forward edge, so that a blade edge width, locally delimited in a radial outer edge portion that includes the projection, is enlarged around the projection, a respective radial outer edge portion of each of the blades at a termination of the blade forward edge includes an axial thickness that is greater than an axial thickness in a rear portion adjacent to a blade rear edge, a second transition of the axial thickness is seamlessly formed from the blade forward edge to the rear portion; and a winglet is formed near the rear portion adjacent to the blade rear edge, the winglet is curved at a predetermined setting angle along an axial outer edge of the respective blades in an axial direction, the profile of the winglet transitions semi-spherically into the termination at the forward portion of the projection and the first and second transitions between the winglet and the semi-spherical termination are seamlessly formed both axially and from the radial outer edge portion to a radially inner portion of the blade.

3. The ventilator wheel according to claim 2, wherein each projection is formed as a lug-shaped extension of the radial outer edge portion and protrudes in the circumferential direction relative to the respective adjacent blade forward edge extending radially outward on the outlet side.

4. The ventilator wheel according to claim 2, wherein the projection extends in the circumferential direction over a length of 1-20%, of the blade edge width of the adjacent blade forward edge.

5. The ventilator wheel according to claim 4, wherein the projection extends in the circumferential direction over a length of 1-10%, of the blade edge width of the adjacent blade forward edge.

6. The ventilator wheel according to claim 2, wherein the radial outer edge portion has a length in the radial direction of 5% of a ventilator wheel radius.

7. The ventilator wheel according to claim 6, wherein the radial outer edge portion has a length in the radial direction of 2.5% of a ventilator wheel radius.

8. The ventilator wheel according to claim 2, wherein the forward portion has an enlarged axial thickness relative to the rear portion, and a width in the circumferential direction, which corresponds to 50%-70% of the blade edge width.

9. The ventilator wheel according to claim 2, wherein the projection has an oval cross section.

10. The ventilator wheel according to claim 2, wherein the projection has an elliptical cross section.

11. The ventilator wheel according to claim 2, wherein the projection, as viewed in the circumferential direction, tapers and is essentially semi-spherical in design.

12. The ventilator wheel according to claim 2, wherein a setting angle in the forward portion or in the region of the projection is smaller than in the rear portion.

13. An axial ventilator having a fixed wall ring and a ventilator wheel rotatable within the wall ring according to claim 2.

* * * * *